US005285905A

United States Patent [19]

Laprade

[11] Patent Number: 5,285,905

[45] Date of Patent: Feb. 15, 1994

[54] SCREENING ASSEMBLY FOR SOIL

[76] Inventor: Réal R. Laprade, 45 Terrace Venice, Coteau-du-Lac, Quebec, Canada, J0P 1B0

[21] Appl. No.: 915,300

[22] Filed: Jul. 20, 1992

[51] Int. Cl.[5] ..... B07B 1/22

[52] U.S. Cl. ..... 209/288; 209/241; 209/245; 209/257

[58] Field of Search ..... 209/240, 241, 244, 245, 209/257, 288

[56] References Cited

U.S. PATENT DOCUMENTS

| | | | |
|---|---|---|---|
| 1,307,458 | 6/1919 | Robbins | 209/240 |
| 1,654,590 | 1/1928 | Kolberg | 209/240 |
| 2,293,228 | 8/1942 | Tucker | 209/257 |
| 2,454,662 | 11/1948 | Marsh | 209/257 |
| 3,002,623 | 10/1961 | Fontaine | 209/288 |
| 4,127,478 | 11/1978 | Miller | 209/240 |
| 4,140,281 | 2/1979 | Fulghum, Jr. et al. | 209/288 |
| 4,226,271 | 10/1980 | Coleman | 209/288 |
| 4,440,637 | 4/1984 | Smit et al. | 209/257 |
| 4,543,029 | 9/1985 | Grün et al. | 209/288 |
| 4,623,449 | 11/1986 | Böhnensieker | 209/288 |
| 4,635,860 | 1/1987 | Kruyer | 209/288 |
| 4,896,835 | 1/1990 | Fahrenholz | 209/288 |
| 4,915,826 | 4/1990 | Nordhus | 209/288 |
| 5,002,656 | 3/1991 | Johansson | 209/288 |

FOREIGN PATENT DOCUMENTS

| | | | |
|---|---|---|---|
| 265421 | 4/1988 | European Pat. Off. | 209/288 |
| 906627 | 2/1982 | U.S.S.R. | 209/288 |
| 1233961 | 5/1986 | U.S.S.R. | 209/288 |
| 17563 | of 1904 | United Kingdom | 209/240 |
| 2107217 | 4/1983 | United Kingdom | 209/288 |
| 2151947 | 7/1985 | United Kingdom | 209/288 |

*Primary Examiner*—D. Glenn Dayoan

[57] ABSTRACT

The screening assembly includes a tilted upwardly movable belt conveyor over which is mounted a rotatable cylindrical drum axially oriented in the direction of the belt conveyor. A mixed soil receiving bucket mounted over the conveyor upstream of the cylindrical drum. The bucket is also transports a mixture of soil and debris towards the cylindrical drum. The cylindrical drum while rotating allows the soil to drop on the belt conveyor while the debris are rejected at the lower end of the drum. The assembly particularly makes use of a screening drum which includes a cylindrical meshed screen supported by two end rings at both ends of the meshed screen. The drum is rotated by a pair of driving wheels located under each of the rings. One of the rings includes an outer radial flange which is adapted to abut on a pair of wheels for preventing the tilted drum from sliding downwardly.

6 Claims, 6 Drawing Sheets

81
D
79
92
100
80
76
94
96
F
82
103
38
30
26
21
16
E
G
22a
18
86
12
B
90
74
14
7
8

SCREENING ASSEMBLY FOR SOIL

BACKGROUND OF THE INVENTION

1. Field of the Invention

The present invention is directed to the screening of granular material and particularly to the sifting of soil. It is particularly directed to a screening method wherein a screening drum or plates are removably fixed on a belt conveyor and located at a low level so that the screened soil is dropped on an upwardly moving tilted conveyor. The conveyor is adapted to drop the sifted soil at its upper end above a truck box body or into a pile for later disposal.

The novel screening arrangement makes use of a novel screening drum which displays a completely free inner space and which rotates on the external surface of two end rings.

The screening arrangement according to the invention has a modular concept which allows the quick and easy interchangeability of the mixed soil receiving bucket and the drum and the substitution of screening plates for the drum.

2. Prior art

A search among prior patents by the applicant, has failed to reveal any pertinent references. In presently available soil screening arrangements, mixed soil is dropped at the lower end of a tilted belt conveyor which brings the soil to a screening drum suspended at the upper end of the conveyor high above the ground. The drum is suspended by an axle extending through its longitudinal axis.

It is well known that soil screening drums produce a considerable amount of flying soil particles when in rotation. Such particles are considerably embarrassing for surrounding workers. When the rotating drum is located high above the ground, the dust produced by the flying soil particles is susceptible of being spread over a greater distance. This distance is further increased by the wind which has a stronger effect on the particles flying at a higher level. Generally, such a problem needs to be controlled by fences or tarpolins when dwellings are located within such vicinity.

Furthermore, the prior soil screening drums are rotated by driving a central longitudinal axles which is supported by radial rods fixed to the cylindrical periphery of the drum. These rods prevent the free longitudinal passage of the mixed soil especially when the later contains large tree roots which get stuck inside the drum or damages the later. The removal of the roots or the repair of the drum is slow, time consuming and lowers the productivity of the process, particularly due to the fact that such axially driven drums require numerous hours of labor for their removal and installation.

SUMMARY OF THE INVENTION

The present invention is directed to a screening assembly for soil comprising a mixed soil receiving bucket having a first conveyor means movably mounted along its bottom surface for transporting a mixture of soil and debris towards one end thereof, a rotatable cylindrical drum axially mounted adjacent said one end of the bucket for receiving the mixed soil from the bucket, and a second conveyor means tiltably mounted under the cylindrical drum and the bucket for collecting the screened soil form the drum. The drum is made of two end rings connected by a cylindrical meshed screen adapted to allow the soil from the mixed soil to pass through the screen, this drum being axially tilted downwardly in a direction away from the bucket for allowing the debris to be dumped out at the lower end of the drum during rotation thereof. The second conveyor means is tilted at an angle substantially corresponding to the inclination of the cylindrical drum, movable means on the second conveyor transporting the screened soil in an upward direction away from the drum and bucket.

In operation, the screened soil is adapted to be dumped at the upper end of the second conveyor means, the debris are adapted to be dumped at the lower end of the drum.

The present invention also relates to a screening drum for mixed soil for separating sifted soil from debris, this drum adapted to operate on a tilted axis. The screening drum comprises (a) a cylindrical meshed material for sifting soil, (b) a ring member axially secured to the meshed material at each end thereof, these ring members comprising an axial flange and one of the ring members comprising an outwardly projecting radial flange, and (c) rotatable wheel means abutting against the axial and radial flanges for upwardly and laterally supporting and rotating the drum, whereby upon rotation of that drum, sifted soil passes through the meshed material and the debris are axially rejected at the lower end of the drum. The screening drum further comprises (d) longitudinal stiffening ribs peripherally extending between both ring members for reinforcing the cylindrical meshed material, and (e) a hooking member secured to one of the longitudinal ribs substantially midway between the ring members, whereby the hooking member is gripped for lifting the cylindrical meshed material removably mounted through abutment of the wheel means on the axial and radial flanges, and for lowering the cylindrical meshed material to abut the wheel means against the axial and radial flanges.

DETAILED DESCRIPTION OF THE INVENTION

Figure 1:
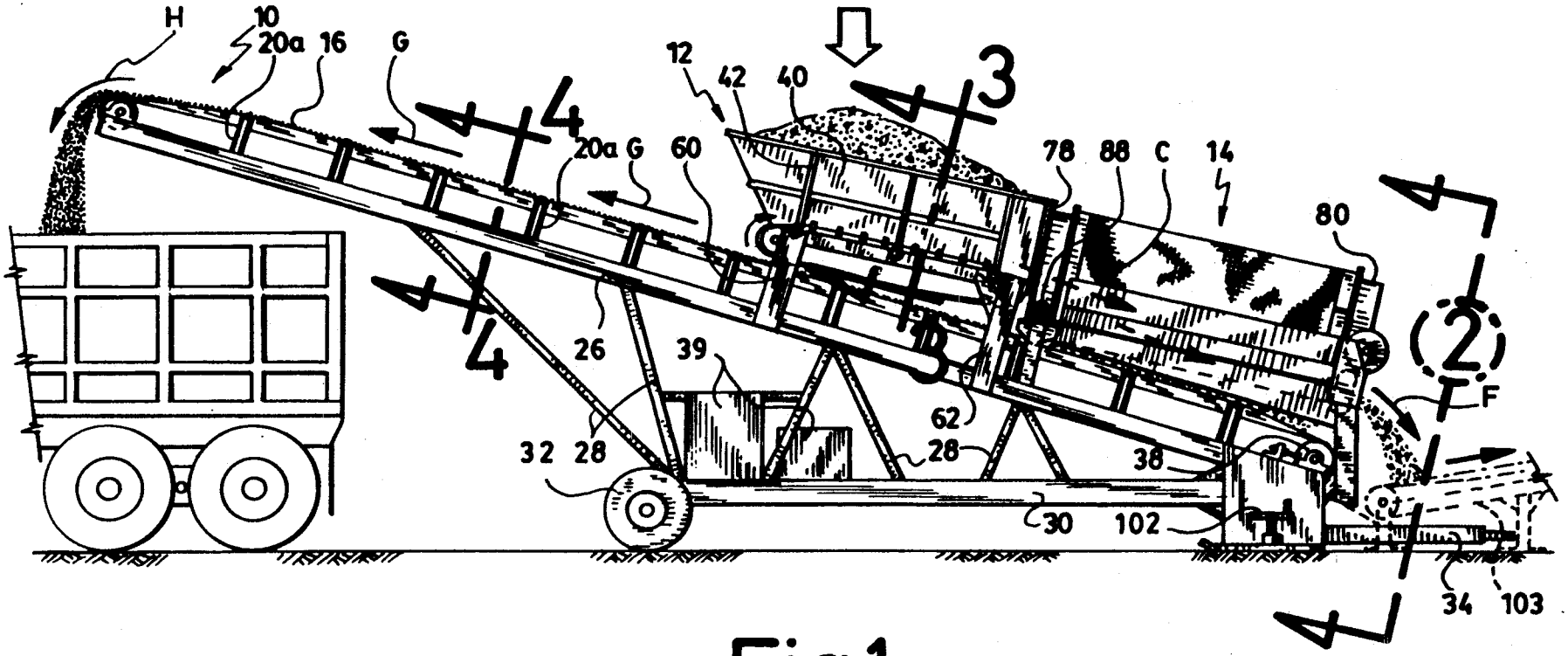
FIG. 1 is a side view of an arrangement for screening mixed soil according to one embodiment of the invention.
Figure 2:
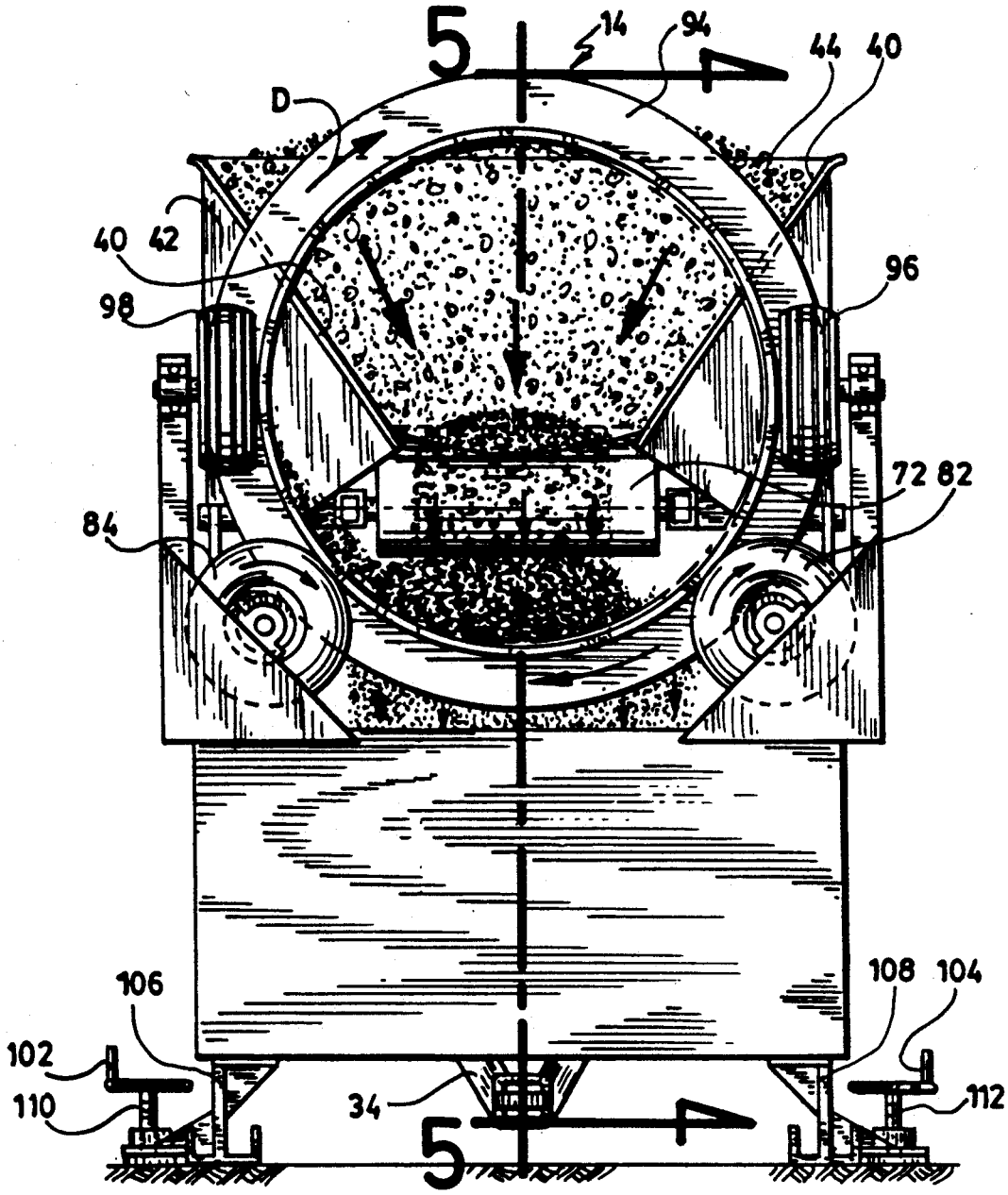
FIG. 2 is an end view along arrow 2 of the arrangement shown in FIG. 1.

FIG. 1 shows a tilted belt conveyor 10 over which is mounted a mixed soil receiving bucket 12 and a cylindrical soil filtering drum 14. The receiving bucket 12 and the drum 14 are located downstream of the conveyor 10. The drum 14 is located downstream of the bucket 12.

Figure 4:
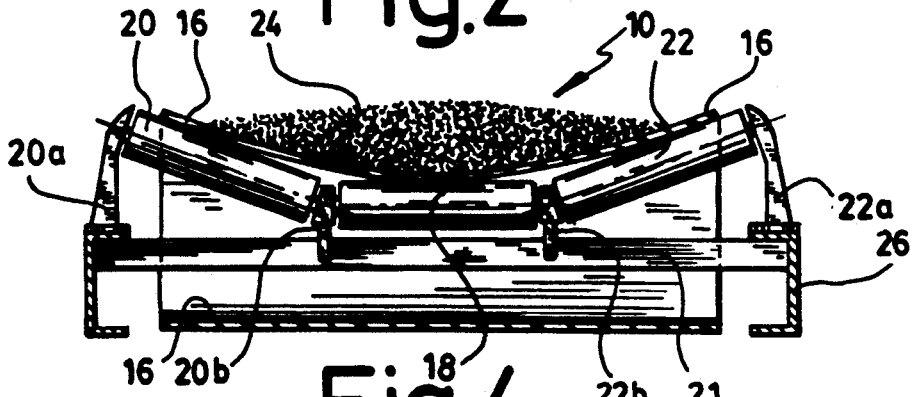
FIG. 4 is a cross-sectional view taken along line 4—4 of FIG. 1 and is shown on the same sheet as FIG. 2.
Figure 3:
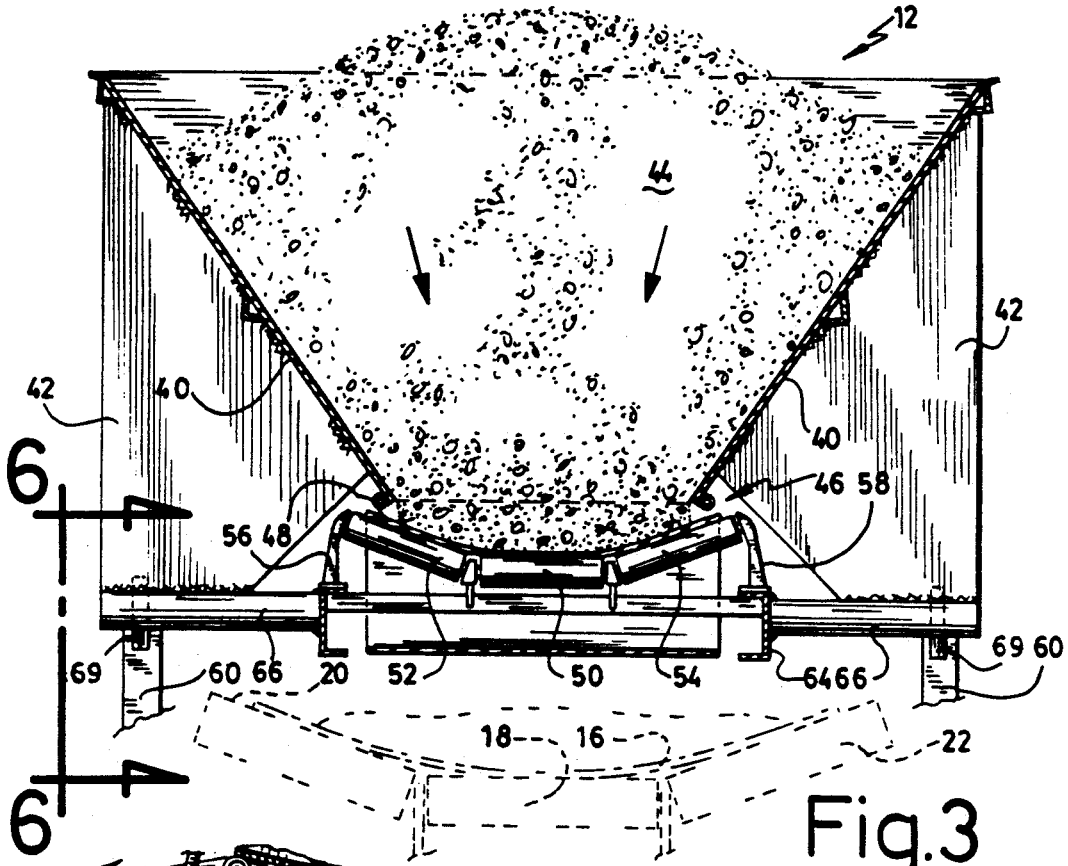
FIG. 3 is a cross-sectional view taken along line 3—3 of FIG. 1.

The belt conveyor 10 as particularly shown in FIG. 4, includes a belt 16 and a set of three adjacently positioned rollers 18, 20 and 22. The central roller 18 is adapted to be horizontal while the lateral rollers 20 and 22 are inclined relative to the central roller 18 to laterally raise the belt 16 and provide lateral support for the screened soil 24 accumulated on the belt 16. It should be understood that the belt 16 needs to be relatively well leveled in order to transport a maximum amount of soil 24. For this purpose, a leveling device is provided and will be explained later.

The belt conveyor 10 includes a frame 26 which extends from the upper to the lower end of the belt 16 and is supported by a plurality of truss beams 28 over a platform 30. The platform 30 is preferably mounted on wheels 32 for transporting the whole screening assembly by pulling on the towing plate 34. The belt 16 travels over both end rollers 36 and 38 rotatably supported at both ends of the frame 26. The belt is driven by a motor 39 through connections (not shown). The motor 39 is sufficiently strong to transport the belt 16 when fully loaded with soil 24. Each lateral roller 20 and 22 is supported on the frame 26 in its tilted position by the lateral arms 20*a* and 22*a* respectively. The central roller 18 is supported by intermediate arms 20*b* and 22*b* secured on a transversal beam 21.

The bucket 12 has sloping lateral panels 40 reinforced with webs 42 for supporting for receiving large quantities of mixed soil 44.

The bucket 12 is provided with its own belt conveyor 46 which includes a belt 48 and a set of three adjacently positioned rollers 50, 52 and 54. The lateral rollers 52 and 54 are inclined substantially in a similar manner as the rollers 20 and 22 described and are laterally supported by the arms 56 and 58.

The bucket 12 including the webs 42 and the belt conveyor 46 is removably mounted over the belt 16 in spaced relationship by footing beams 60 and 62. The frame 64 supporting the rollers 50, 52 and 54 and the arms 56 and 58, is provided with transverse beams 66 adapted to rest on wedge members 68 and 69. In its tilted position, the bucket 12 is held downwardly and longitudinally by the wedge members 68 and 69. Accordingly, the bucket 12 can be lowered and lifted out of its supporting wedge members by a crane (not shown). The facility with which the bucket 12 can be removed makes it possible to substitute various kinds and sizes of buckets.

Figure 6:
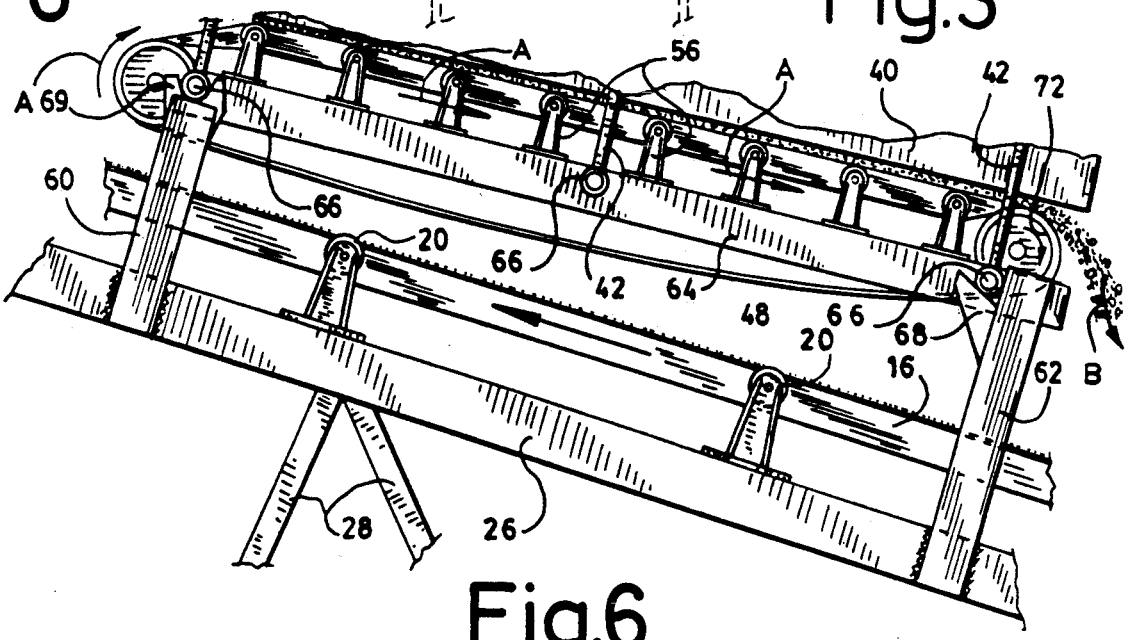
FIG. 6 is a side view taken along line 6—6 of FIG. 3 and is shown on the same sheet as FIG. 3.

The belt 48 rotates around the two end rollers 70 and 72 which are motor driven by motors 39 to transport the mixed soil 44 in the direction of the arrows A for bringing the mixed soil in the direction of the arrow B in FIG. 6 and C in FIG. 1. With this arrangement, the mixed soil reaches the internal space of the cylindrical soil filtering drum 14.

Figures 5, 7, 8:
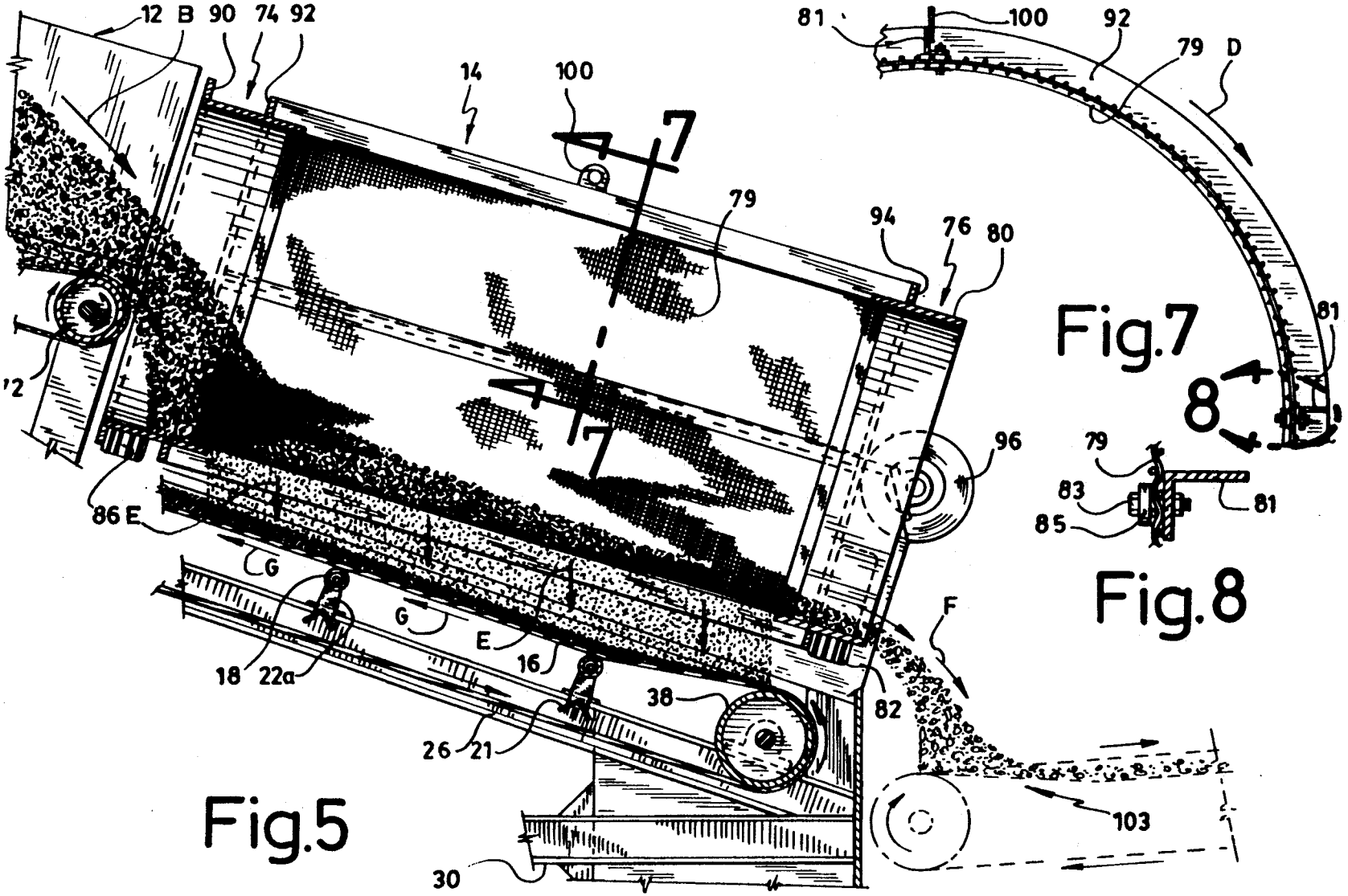
FIG. 5 is a cross-sectional view taken along line 5—5 of FIG. 2.
FIG. 7 is a cross-sectional view taken along line 7—7 of FIG. 5.
FIG. 8 is an enlarged view of encircled portion 8 of FIG. 7.
Figure 10:
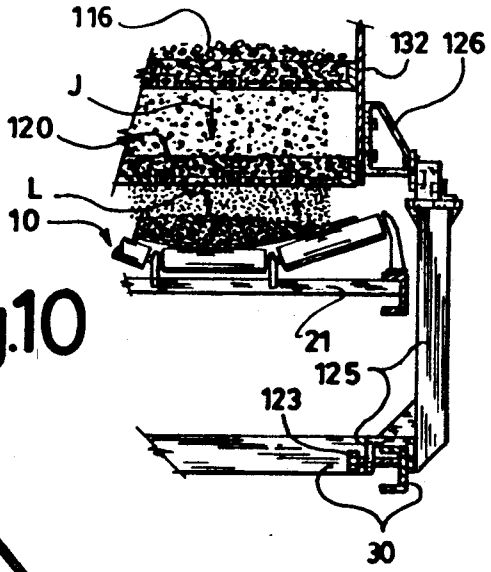
FIG. 10 is a cross-sectional view taken along line 10—10 of FIG. 9.

The drum 14 is essentially made of two end ring members 74 and 76 and a sifting screen 79. The ring members 74 and 76 are provided with axial flanges 78 and 80 respectively. The flange 76 is adapted to ride on a pair of wheels 82 and 84 and flange 78 is adapted to be supported and ride on the wheels 86 and 88. The wheels 86 and 88 rotates between two radial flanges 90 and 92 and the ring member 76 is provided with a radial flange 94 which rides on a pair of wheels 96 and 98 for preventing the drum 14 from sliding downstream considering that the drum is tilted at substantially the same angle as the belt conveyor. With this arrangement, the drum 14 can be lowered and lifted out of its operating position by grabbing it with a lifting hook (not shown). The sifting screen 79 is a meshed material reinforced by longitudinal ribs 81 secured at both ends to the ring members 74 and 76. As shown in FIG. 8, the ribs 81 are secured on the screen 79 with bolts 83 and washer 85. An eye 100 is secured on one of the ribs 81 at about mid-distance between both end rings 74 and 76.

The wheels 82, 84, 86 and 88 which are preferably made of rubber tires are motor driven to spin the drum about its axis in the direction of the arrow D. The mixed soil coming from the bucket 12 unfiltered in the direction of the drum 14, drops the mixed soil inside the drum 14 while the latter spins about its longitudinal axis. Due to gravity, the soil has a tendency to go through the meshed portion 79 of the drum 14 and to fall in the direction of the arrows E over the belt 16 about its lower section adjacent the roller 38. The portion of the mixed soil which does not sift through the meshed surface 79 of the drum slides through gravity in the direction of the arrow F outside the drum 14. It is contemplated to use a belt conveyor 103 to receive the unscreened soil from the drum 14 for transporting it away from the screening assembly herein described. The screened soil which falls on the belt conveyor 16 in the direction of the arrow E is brought upwardly on the belt 16 in the direction of the arrow G which extends under the bucket 12 and upwardly to a raised position sufficient to be dumped in the direction of the arrow H in a box body of a truck or to simply being piled up on the ground for future use.

With this arrangement, a screening drum 14 has an internal volume which is completely opened and free to accept the entrance of large debris and roots from the bucket 12 and move freely from the ring 74 to the ring 76 without internal interference of radial or axial webs which generally need to support the mesh portion 79 of the drum.

As stated above, it is important that the belt conveyors 10 and 46 be leveled so that the soil which is accumulated over them be maintained at its maximum capacity and prevent the soil from shifting sideways over the respective belts of each of the belt conveyors 10 and 46. For this purpose, a pair of leveling devices 102 and 104 are secured to the understructure 106 and 108 supporting the screening assembly on the ground. The leveling devices 102 and 104 make use of threaded rods 110 and 112 adapted to raise or lower one side or the other of the screening assembly. Similar leveling devices are contemplated in the vicinity of the wheels 32 but are not illustrated in the figures.

A different embodiment for screening the soil is illustrated in FIGS. 9–12 which consists of a vibrating assembly 114 which is substituted for the filtering drum 14 and which is situated at the exit of the soil receiving bucket 12. It forms part of the modular concept of the present invention.

The mixed soil 44 is projected by the belt conveyor 46 onto a first vibrating platform 116 which is provided with a coarse meshed material allowing large granular material to pass through the platform 116 in the direction of the arrows J. The platform 116 is tilted so that the granular material which exceeds the size allowed to pass through the platfrom 116 will move in the direction of the arrows K outside the vibrating assembly 114 and be picked up by a belt conveyor 118.

The granular material which has passed through the meshed material of the first vibrating platform 116 drops on a second vibrating platform 120 below the first vibrating platform 116 and substantially tilted at the same angle. The meshed material of the second platform 120 is finer than the one of the first platform 116 and allows the passing through of a finer granular material in the direction of the arrows L. However, the granular material which has reached the second platform 120 but which is too large to penetrate the latter, will, due to the vibrating motion of the second platform, reach the belt conveyor 122.

The fine granular material which has succeeded to pass through the second platform 120, in the direction of the arrow L, is dropped on the main tilted belt conveyor 10 and moves upwardly in the direction of the arrow G to reach a similar destination as explained in the previous embodiment.

Figure 9:
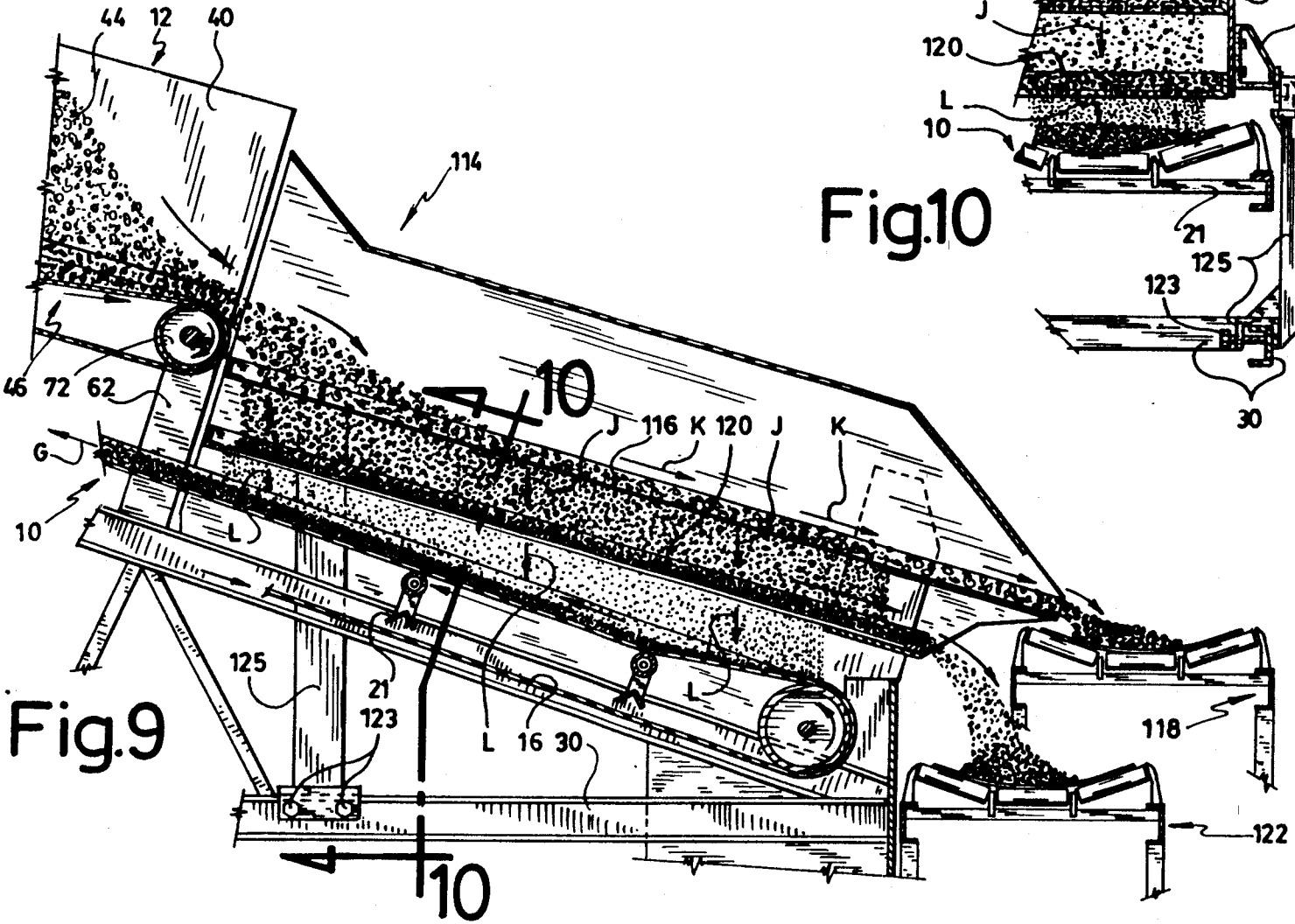
FIG. 9 is a cross-sectional view along line 9—9 of FIG. 12 of an alternative embodiment taken through vibrating plates when 13 substituted to the drum shown in FIG. 5.
Figure 12:
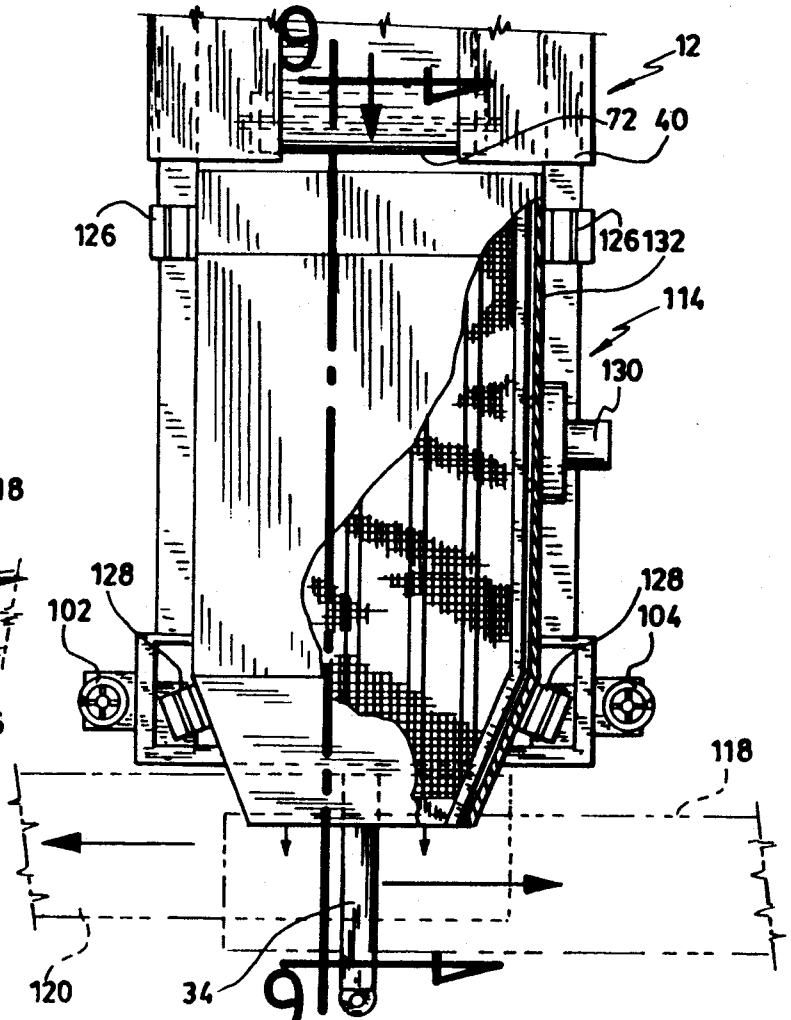
FIG. 12 is a top view along arrow 12 shown in FIG. 11.
Figure 11:
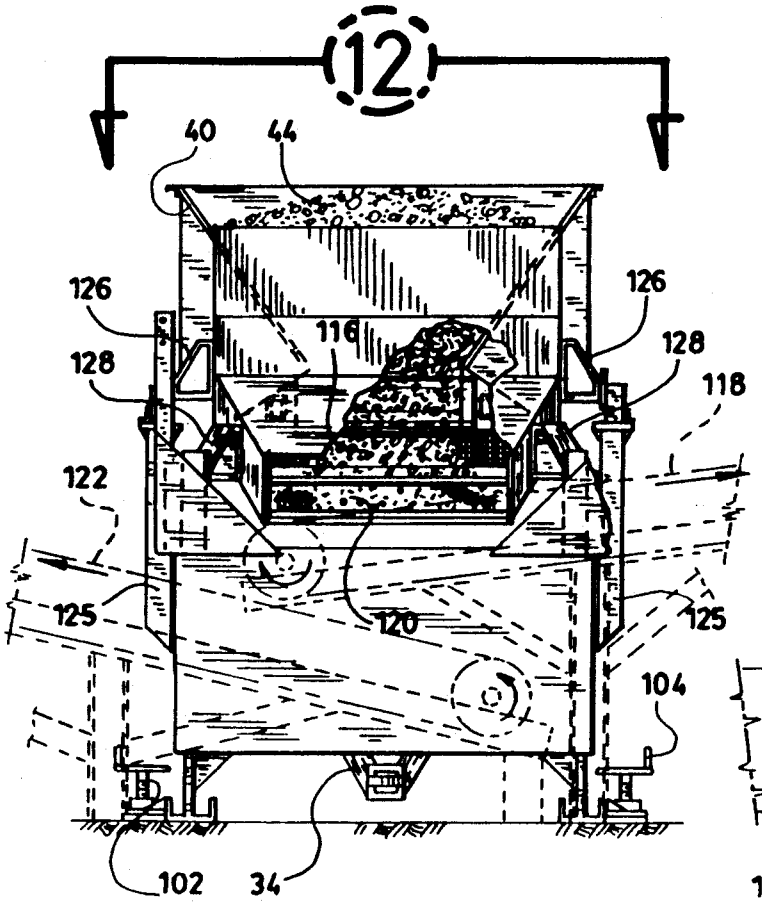
FIG. 11 is a rear view of the embodiment shown in FIG. 9.

As seen in FIG. 11, from the rear end of the embodiment shown in FIG. 9, the two belt conveyors 118 and 122 are shown to be travelling in opposite directions and upwardly inclined to bring the collected granular material at an elevated station.

The vibrating assembly 114 is supported on the frame 30 by lateral beams 125 which itself supports the belt conveyor 10. The beams 125 are removably connected to the frame 30 by bolts 123. It forms part of the modular assembly of the invention and is used particularly when sand, rocks, charcoal and other similar dry materials need to be screened. The vibrating assembly 114 is substituted for the drum 14 described earlier.

The vibrating platforms 116 and 120 are supported by resilient means identified by lateral beams 126 and 128. A motor 130 located between the beams 126 and 128 on one side of the vibrating platforms 116 and 120 abuts on a lateral wall 132 for causing vibration through a set of cams and springs (not shown).

Although one type of the vibrating assembly has been previously described, it should be understood that various types of conventional vibrating means are adaptable to the present invention which essentially consists in mounting the vibrating assembly over the lower end of a tilted belt conveyor, in a modular fashion. The belt conveyor is adapted, upon rotation, to upwardly transport the screened granular material at its upper end for subsequently dumping the material in a box truck or into a pile.

I claim:

1. A screening assembly for soil comprising, a mixed soil receiving bucket having a first conveyor means movably mounted along its bottom surface for transporting a mixture of soil and debris towards one end thereof, a rotatable cylindrical drum axially mounted adjacent said one end of said bucket for receiving said mixed soil from said bucket, said drum being made of two end rings connected by a cylindrical meshed screen adapted to allow the soil from said mixed soil to pass through the screen, said drum being axially tilted downwardly in a direction away from said bucket for allowing the debris to be dumped out at the lower end of the drum during rotation of the latter, a second conveyor means tiltably mounted under said cylindrical drum and said bucket for collecting said screened soil from said drum, said second conveyor means being tilted at an angle substantially corresponding to the inclination of the cylindrical drum, movable means on said second conveyor for transporting said screened soil in an upward direction away from said drum and said bucket, whereby said screen soil is adapted to be dumped at the upper end of said second conveyor means, and said debris are adapted to be dumped at the lower end of said drum.

2. A screening assembly for soil as recited in claim 1, wherein said bucket and said first conveyor means are tilted at an angle similar to the tilt of said drum.

3. A screening assembly for soil as recited in claim 2, successive central rollers and a pair of lateral rollers on each side of said central rollers, said lateral rollers being tilted in the direction of the central rollers, a belt conveyor rotatably mounted over said central and lateral rollers for respectively supporting said mixed soil and screen soil, and means for driving both of said conveyor means.

4. A screening assembly for soil as recited in claim 3, comprising a pair of driving wheels located under each of said rings for supporting and rotating said drum around its longitudinal axis.

5. A screening assembly for soil as recited in claim 2, comprising a pair of abutting wheels rotatably mounted at the lower end of said drum in abutting relationship with said ring located at the lower end of said drum, whereby said abutting wheels prevent said drum from downwardly sliding in its tilted direction.

6. A screening drum for mixed soil for separating sifted soil from debris, said drum adapted to operate on a tilted axis, said screening drum comprising (a) a cylindrical meshed material for sifting soil, (b) a ring member axially secured to said meshed material at each end thereof, said ring members comprising an axial flange and one of said ring members comprising an outwardly projecting radial flange, and (c) rotatable wheel means abutting against said axial and radial flanges for upwardly and laterally supporting and rotating said drum, whereby upon rotation of said drum, sifted soil passes through said meshed material and said debris are axially rejected at the lower end of the drum; and wherein said screening drum further comprises (d) longitudinal stiffening ribs peripherally extending between said ring members for reinforcing said cylindrical meshed material, and (e) a hooking member secured to one of said longitudinal ribs substantially midway between said ring members, whereby said hooking member is gripped for lifting said cylindrical meshed material removably mounted through abutment of said wheel means against said axial and radial flanges, and for lowering said cylindrical meshed material to abut said wheel means against said flanges.

* * * * *